United States Patent [19]

Cable et al.

[11] 4,235,054

[45] Nov. 25, 1980

[54] BUILDING WALL STRUCTURE

[75] Inventors: Daniel K. Cable, Lakewood; Jack Doke, Los Angeles, both of Calif.

[73] Assignee: Angeles Metal Trim Co., Los Angeles, Calif.

[21] Appl. No.: 851,289

[22] Filed: Nov. 14, 1977

Related U.S. Application Data

[63] Continuation of Ser. No. 712,727, Aug. 9, 1976, abandoned, which is a continuation of Ser. No. 35,648, May 8, 1970, abandoned.

[51] Int. Cl.[2] ..... E06B 1/04

[52] U.S. Cl. ..... 52/210; 52/238; 52/481

[58] Field of Search ..... 52/481, 376, 238, 348-350, 52/210, 220, 238, 664, 615, 656, 241, 242, 285, 281, 234, 284

[56] References Cited

U.S. PATENT DOCUMENTS

| | | | |
|---|---|---|---|
| 1,729,439 | 9/1929 | Gordee | 52/210 |
| 1,748,794 | 2/1930 | Ray | 52/349 |
| 1,821,015 | 9/1931 | Hall | 52/729 |
| 1,959,880 | 5/1934 | Sims | 52/262 |
| 2,065,493 | 12/1936 | Greulich | 52/220 |
| 2,067,403 | 1/1937 | Lea | 52/242 |
| 2,101,090 | 12/1937 | Palmer | 52/210 |
| 2,256,394 | 9/1941 | Camel | 52/210 |
| 2,281,402 | 4/1942 | Wilson | 52/210 |
| 2,302,101 | 11/1942 | Boydstun | 52/210 |
| 2,313,839 | 3/1943 | Olsen | 52/238 |
| 2,445,491 | 7/1948 | Moloney | 52/220 |
| 2,633,610 | 4/1953 | Hervey | 52/238 |
| 2,795,305 | 6/1957 | Bagge | 52/364 |
| 2,845,152 | 7/1958 | Parent | 52/730 |
| 2,854,843 | 10/1958 | Lamb | 52/210 |
| 3,243,930 | 4/1966 | Slowinski | 52/241 |
| 3,244,802 | 4/1966 | Sturevant | 16/2 |
| 3,245,185 | 4/1966 | Roe | 52/238 |
| 3,339,323 | 9/1967 | Johansson | 52/210 |
| 3,363,371 | 1/1968 | Villalobos | 52/210 |
| 3,415,024 | 12/1968 | Kotlarz | 52/220 |
| 3,418,778 | 12/1968 | Manderbach | 52/241 |

FOREIGN PATENT DOCUMENTS

| | | | |
|---|---|---|---|
| 165524 | 1/1953 | Australia | 52/481 |
| 253286 | 5/1963 | Australia | 52/481 |

OTHER PUBLICATIONS

*Structural Steel Studs* ©, 1965, *Sweet's Catalog Service*, section 2a/1n, pp. 2 and 3.

*Primary Examiner*—Price C. Faw, Jr.
*Assistant Examiner*—Henry E. Raduazo
*Attorney, Agent, or Firm*—Reed C. Lawlor

[57] ABSTRACT

The present invention comprises a portable wall structure including a metal cap forming the top of a wall structure, a metal floor track forming the bottom of the wall structure, and a series of channeled load-bearing studs that are secured vertically between the cap member and the floor track member. These vertical studs are composed of steel of about 20 gauge thickness. A vertical steel stud is positioned at each end of the wall structure to provide closed ends of the wall structure. This wall structure forms a separate unit of substantially rectangular configuration which may be prefabricated and separately transported to a building construction site. Some parts, such as top plates, corners, door surrounds, and window surrounds, made of wood, are included in some embodiments of the invention.

12 Claims, 18 Drawing Figures

FIG. 7.
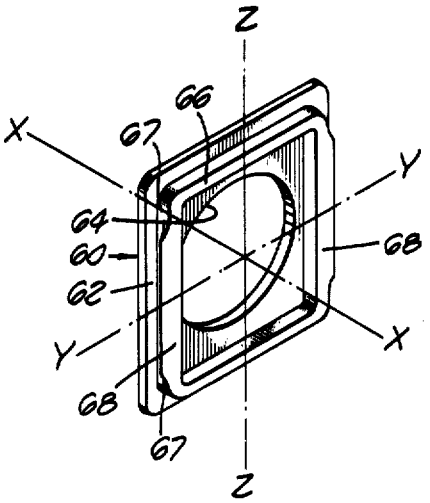
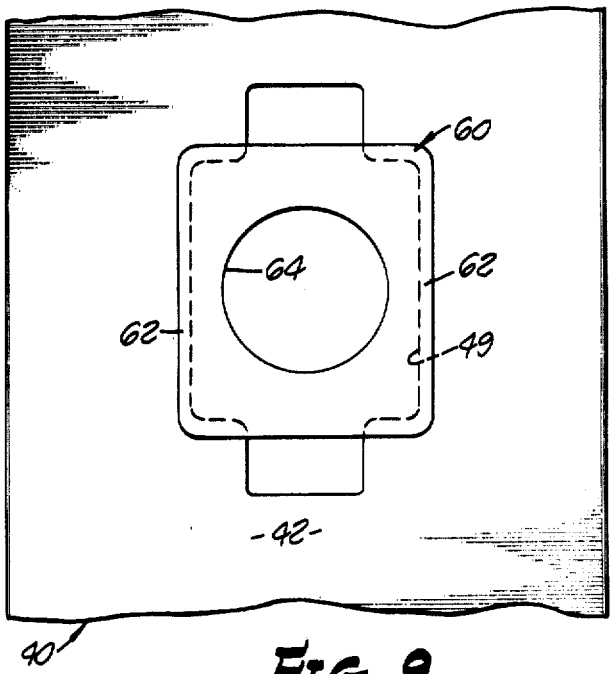
FIG. 9.
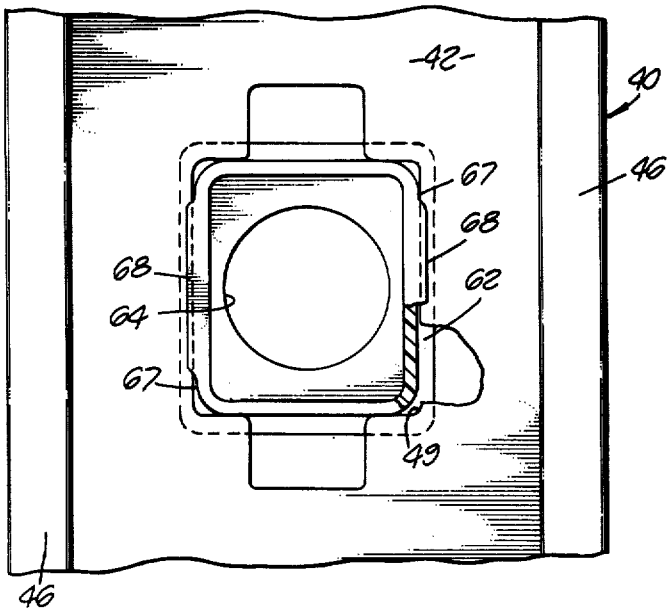
FIG. 8.

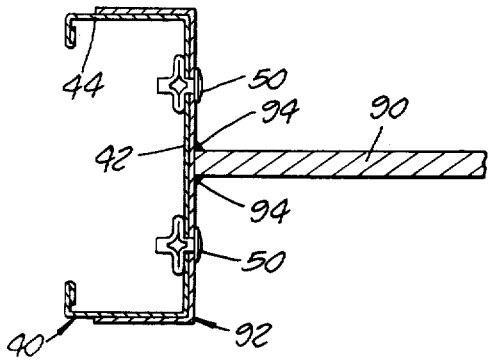
FIG. 15.
FIG. 16.
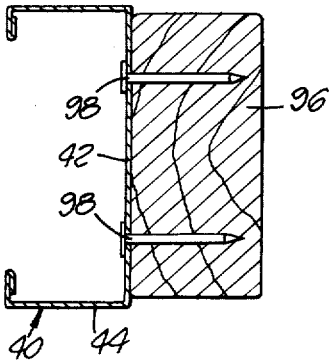
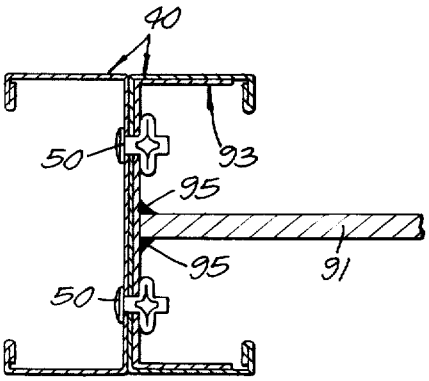
FIG. 17.
FIG. 18.
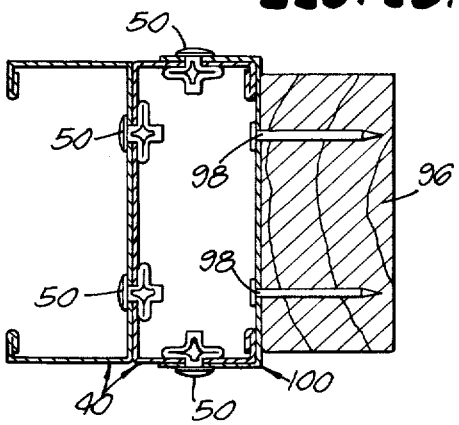

BUILDING WALL STRUCTURE

CROSS REFERENCE TO RELATED APPLICATIONS

This application is a continuation of patent application Ser. No. 712,727 filed Aug. 9, 1976 which in turn was a continuation of patent application Serial No. 35,648 filed on May 8, 1970, both now abandoned.

BACKGROUND OF THE INVENTION

This invention relates to a prefabricated wall structure capable of being transported to a construction site and readily installed and, more specifically, to a prefabricated wall section in which the load-bearing studs are composed of steel of about 20 gauge thickness. These studs are secured vertically between a metal cap member and a floor track member which form the top and bottom of the wall section respectively.

Prefabricated load-bearing wall sections presently used in building construction are made either entirely of wood or of metal load-bearing studs having a thickness of 16 gauge or thicker. These prefabricated metal wall sections suffer from the disadvantages of being heavy, unwieldy, and relatively unworkable with the hand tools usually found at a construction site. In addition, wood wall sections, though workable, are usually not uniform in size since variations in humidity affect the dimensions of wooden members. For this reason, a straight wooden wall section is difficult to produce economically. The use of kilndried wood runs up the cost. And green or partially dried wood is subject to warping and dimensional changes. Further, green wood shrinks causing nail-pop in dry-wall surfaces. These disadvantages were previously accepted as unavoidable in order to obtain the required load-bearing characteristics for the entire wall section.

SUMMARY OF THE INVENTION

We have discovered, however, that by constructing a prefabricated metal load-bearing wall section of steel studs having a thickness of about 20 gauge, the entire wall section acquires new and desirable characteristics and has many advantages over the wall sections previously employed while still exhibiting the necessary load-bearing characteristics. As used herein, "20 gauge" means the thickness of a member within the range of 18 to 22 gauge, 1.38 to 0.82 mm, or 0.0545 to 0.0322 inches. The steel referred to herein is hot dipped galvanized strip steel. An example of the type of a steel employed is designated as ASTM-A446A. This steel has a yield strength of 33,000 psi and a tensile strength of 48,000 psi, thus rendering it suitable for use in both single-story and two-story construction.

Besides the usual advantages of repeatability of quality and accuracy and speed of construction attributable to most prefabricated structures, the main advantage of our invention is the achievement of a lightweight prefabricated wall section which possesses the necessary load-bearing and other characteristics required for use in building construction. For example, typically a 10 foot wall section constructed of 16 gauge steel studs would weigh about 97 pounds, a similar wall section constructed of 2×4 wooden members would weigh about 134 pounds. But in this invention a similar wall section constructed of 20 gauge steel studs typically weighs only 70 pounds. This allows the 20 gauge sections to be more easily carried and erected by hand without the use of cranes and other heavy equipment.

The wall section of this invention has the additional advantage of being workable. That is, the members of a wall section constructed of 20 gauge steel may be cut at the construction site with a hand-held power saw or with metal shears, or the like. Pieces of the 20 gauge steel members may be bent and formed by hand in order to provide apertures or spaces in the members for the passage of previously installed plumbing and the like. Screws may also be conveniently driven through 20 gauge steel in order to secure wallboard and the like to the metal members. Nails may be driven through 20 gauge steel with a hammer into wooden members on the opposite side in order to secure the wooden members to the metal members.

The wall section of this invention is also flexible to such an extent that it will conform to irregularities in a concrete floor of the type which is often employed in the construction of residential homes. The type of irregularity referred to is not surface roughness but rather irregularities such as a 10 foot section of floor which is bowed so that its center is ½ inch higher than its ends.

In the best embodiment of the invention, an additional advantage is obtained by constructing the wall sections in lengths less than about 20 feet. Wall sections of such lengths may be lifted conveniently by three men and may be moved easily from one place to another without the awkwardness which results from increased weight and excessive flexibility when handling longer wall sections.

In the best embodiment, the metal studs of the wall section of this invention are C-shaped. This C-shape of the metal studs gives the studs more load-bearing capability and also gives the flanges of the studs more rigidity so that the flanges are less likely to bend when screws and the like are driven through the flanges in order to secure a wallboard and the like to the flanges.

All of these advantages of lightweight, workability, flexibility, and maneuverability provide a substantial saving in cost to the constructor. For example, a typical one-story residential house may be framed with the 20 gauge steel prefabricated wall sections of this invention in approximately 50 minutes. This is about four to eight times faster than the same house could be framed if wooden wall sections constructed at the building site were employed. If prefabricated wooden wall sections are employed, the extra cost to the contractor results from the extra weight of the wooden wall sections.

This invention provides a prefabricated module for use in a load-bearing metal wall structure. The module comprises an elongated normally horizontal cap member that overlies the top of a series of vertical metal studs and an upwardly facing metal floor track member that receives the lower ends of a series of the metal studs. The studs, cap member and floor track member are all flexible, being fabricated of lightweight metal having a thickness no greater than 18 gauge.

At least one wooden top plate that has a length substantially equal to that of the cap member and the floor track member and extends in the direction of elongation of the cap member is secured to the cap member forming an integral part of the module. The top plate forms the top of the module while the track member forms the bottom of the module. This module forms a separate unit which is adapted to be separately transported to a building construction site.

The wall structure of this invention constitutes a lightweight, flexible prefabricated module that is transportable as an integral unit from a prefabricated site to a building site where it is erected and assembled with other modules to form part of a wall frame onto which wall surface material is then mounted and secured. The vertical studs and the track member are both free of wooden reinforcing members and the module is free of coextensive wall-surface material at the time of prefabrication and during transportation to the building site. The wooden top plate serves to rigidify the lightweight module to facilitate transportation and erection.

Many objects and advantages of this invention will become evident to those skilled in the art upon a reading of the following description and drawings wherein:

THE DRAWINGS

FIG. 7 is a perspective view of an insulating guide employed in this invention;

FIG. 8 is a sectional elevation view of the back side of the insulating guide shown in FIG. 7 when installed in the wall structure;

FIG. 9 is a sectional elevation view of the front side of the insulating guide shown in FIG. 7 when installed in the wall structure;

FIG. 15 is a sectional plan view taken along the line 15—15 in FIG. 13;

FIG. 16 is a sectional plan view taken along the line 16—16 in FIG. 13;

FIG. 17 is a sectional plan view of another type of header construction which may be employed in this invention; and FIG. 18 is a sectional view of a portion of the wall section shown in FIG. 17 taken below the section shown in FIG. 17.

DETAILED DESCRIPTION

Figures 1, 2:
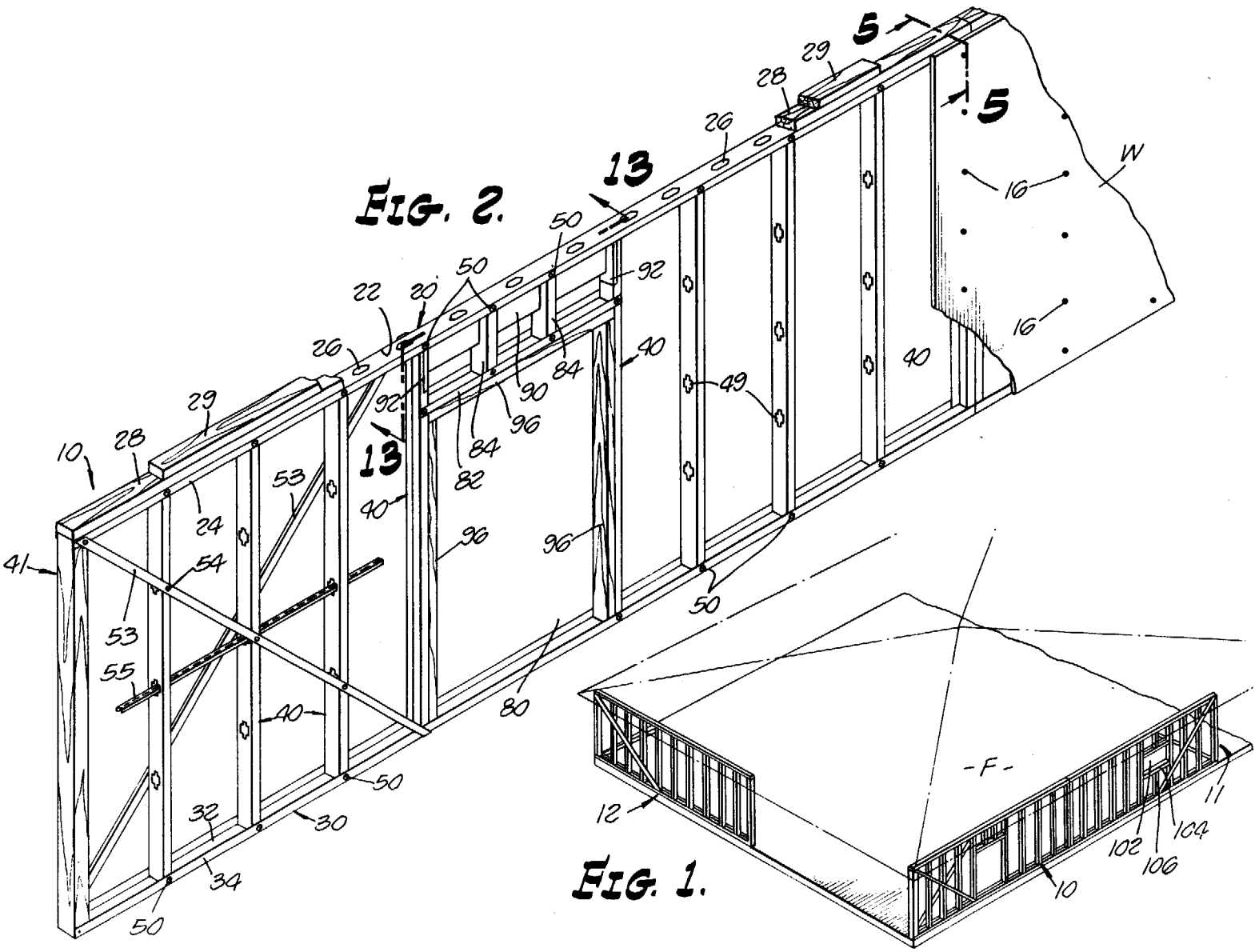
FIG. 1 is a perspective view of a part of a residential home during construction showing partial framing of the house utilizing the wall structures of this invention.
FIG. 2 is a perspective view of one embodiment of this invention.

FIG. 1 is a perspective view of a typical residential house which has been partially framed with wall structures or wall sections 10, 11, and 12 of this invention. Wall sections 10, 11, and 12 are prefabricated at a plant remote from the building construction site and are transported to the building construction site by truck. Wall sections 10, 11, and 12 are then carried from the truck, placed on the house floor F, and held in place while they are secured to the floor F and are secured to each other.

Wall sections 10, 11, and 12 are typically 16 or 20 feet in length, 8 to 10 feet high, and 2½ to 6 inches wide. In the best embodiment of this invention, the wall sections are 16 feet long, 8 feet high, and 5⅝ inches wide. This provides a wall section which is easily handled by three men. If the wall sections are constructed in greater lengths, say 30 feet, they will become practically uncontrollable because of the flexibility of the wall section.

If the floor F of the house consists of a concrete slab, it is the common practice to secure the wall section 10 to the floor F by shooting pins 13 through washers 14, through the web 32 of the track 30 (see FIG. 3) of the wall section 10, and into the concrete floor F. If the floor F is wooden, the wall sections 10, 11, and 12 may be secured to the floor F by nailing through the track member 30. The wall sections 10, 11, and 12 are then secured to adjacent wall sections as will be explained hereinafter.

FIG. 2 shows wall section 10 in greater detail. Wall section 10 is composed of a downwardly facing channeled cap member 20, which provides the top of the wall section 10, and upwardly facing elongated channeled floor track member 30, which provides the bottom of the wall section 10. Cap 20 and floor track 30 are positioned horizontally above and below metal studs 40 respectively and, in the best embodiment of the invention, are both 16 feet in length.

Figure 3:
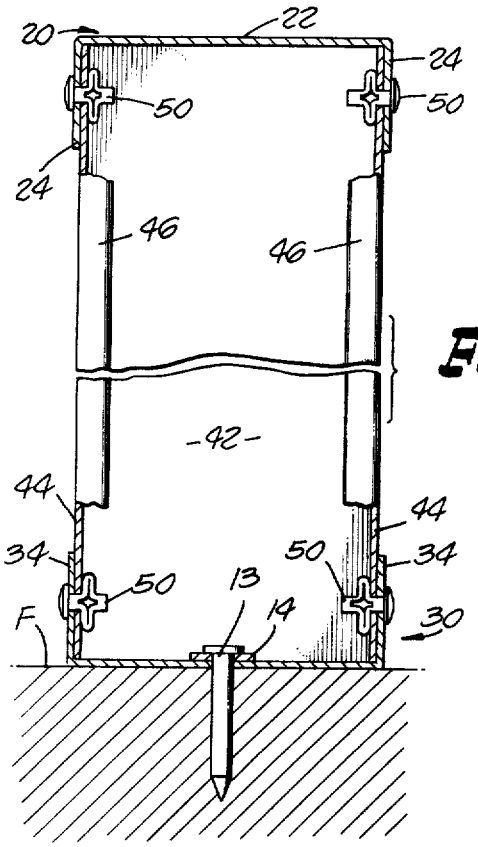
FIG. 3 is a sectional elevation view of a portion of a wall section of this invention.

As is shown in FIGS. 2 and 3, the top cap member 20 and the lower track member 30 are typically composed of U-shaped channeled metal members. Cap member 20 is composed of an elongated main web 22 and downwardly depending flanges 24 extending longitudinally of and integral with each side of main web 22. Floor track 30 is composed of elongated main web 32 and upstanding flanges 34 extending longitudinally of and integral with each side of main web 32. In the best embodiment of this invention, members 20 and 30 are composed of steel of about 20 gauge thickness.

Figure 4:
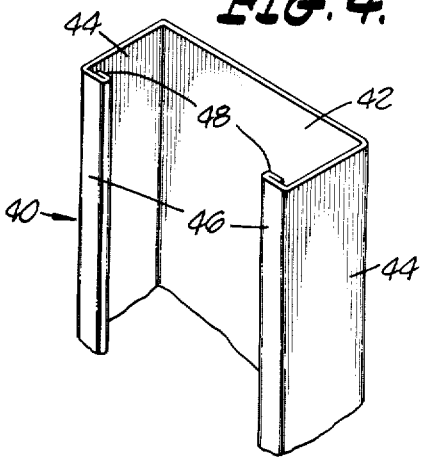
FIG. 4 is a perspective view of a typical stud employed in this invention.

As is shown in FIG. 2, a series of parallel channeled studs 40 are secured vertically between the cap member 20 and the floor track member 30 at between one and two-feet intervals, normally every 16 or 24 inches. In the best embodiment of this invention, studs 40 are composed of C-shaped channeled members, having a thickness of about 20 gauge. This C-shape is best seen in FIG. 4. Channeled studs 40 are composed of a main web 42 and relatively narrow flanges 44 extending longitudinally of and integral with each side of web 42.

In the best embodiment of the invention, stud 40 is also provided with inwardly projecting flange lips 46 and returns 48 extending along the length of and integral with flanges 44. It is common practice to screw wallboard W and the like to flanges 44 of studs 40 with screws 16 passing through the flanges 44 (see FIGS. 2 and 5). Lips 46 and returns 48 provide structural strength to studs 40 and also provide rigidity to flanges 44 so that they will not bend inwardly towards each other when subjected to the force of the screws 16 when wallboard W is screwed to the studs 40.

As may be seen in FIGS. 2, 3, 5, and 6, the flanges 44 of the studs 40 are secured to the flanges 21 and 34 of the cap member 20 and floor track member 30 respectively by welds, nails, clinching, screws, and the like. Clinching will be explained hereinafter in reference to securing wall sections together, but it will be recognized that this method may be employed for securing the studs 40 to the cap 20 and track 30.

Figure 5:
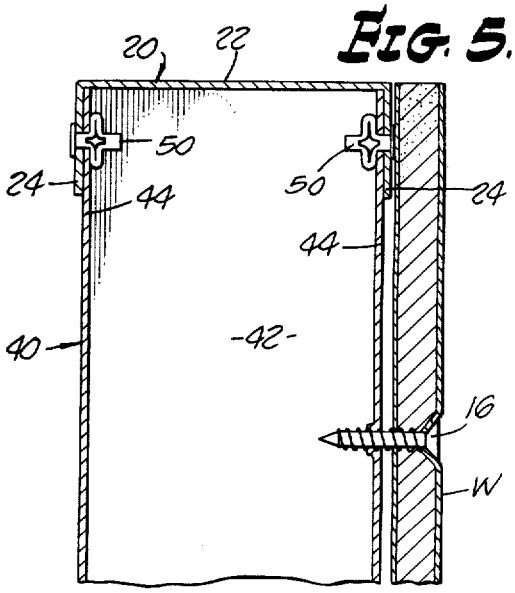
FIG. 5 is a sectional view taken along the line 5—5 of FIG. 1.
Figure 6:
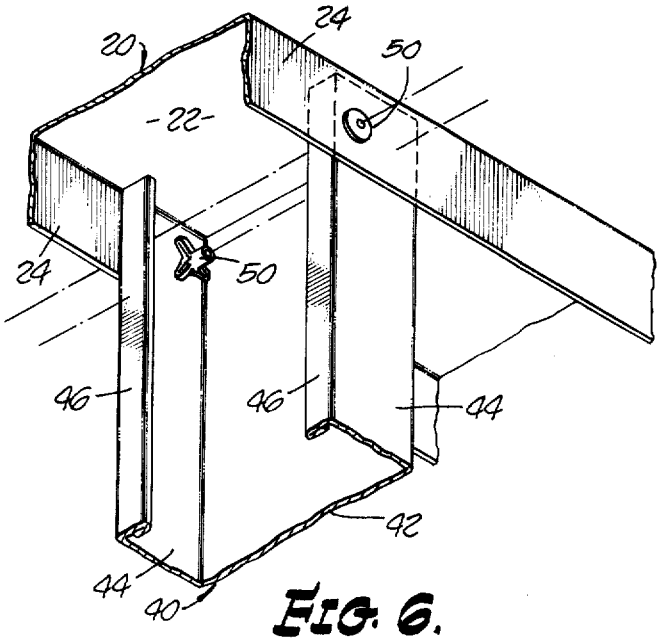
FIG. 6 is a perspective view showing the connection of one of the studs and the cap member employed in this invention.

In the best embodiment of this invention, the studs 40 are secured to the cap 20 and floor track 30 by riveting, as is shown in FIGS. 3 and 5. Riveting is employed because it is faster than the other methods mentioned and provides a more flexible wall section than is obtained with the use of welding. Also, it has been found that welds tend to break or pop when subjected to the strain which occurs when the wall sections sway and twist, as is likely to happen when any flexible structure is being handled by workmen.

"Low profile" blind rivets 50 are employed in this embodiment of the invention in order to prevent excessive bulging of the wallboards W which are to be secured to the stud flanges 44 (see FIG. 5). A low profile rivet 50 is one whose head is substantially flat, about 1/16 inch thick, and which may be driven so that its head will rest flat against the flange 24 of the cap member 20 to present a relatively smooth surface to the interior of any wallboard W which may later be secured to the stud 40.

These rivets 50 secure each flange 24 of the cap member 22 and each flange 34 of the floor track 30 to each flange 44 of the stud 42. The rivets in each end of each stud 40 are driven so that they are coaxially offset (see FIG. 6) from each other (that is, they are not coaxial) in order to reduce the possibility of rotation of the stud about a common axis of these rivets.

As is shown in FIG. 2, the cap member 20 has hexagonal-shaped apertures 26 spaced along the length of the main web 22. Apertures 26 are about 4½ inches long by about 1-9/16 inches wide and are typically spaced apart about 6 inches along web 22, although a greater spacing in shown in FIG. 2 for clarity. These apertures 26 allow for the convenient passage of plumbing pipes, electrical conduits, and the like (not shown) through the cap member 20.

Top plates 28 and 29, composed of 2×4 wooden members, are secured to the cap web 22 by nails or the like. Lower top plate 28 typically extends continuously from one end of cap member 20 to the other. Upper top plate 29 usually terminates short of the ends of the wall section. This allows the wall sections to be secured together easily at the construction site by nailing 2×4 wooden members to the lower top plates 28 between the ends of the upper top plates 29 of two adjacent wall sections.

A pair of shear straps 53 are secured diagonally across one end of wall section 10 in order to provide against the rotation of the studs 40 about their ends in the longitudinal direction of the wall section 10. Straps 53 are typically composed of 16 gauge steel straps, about 2 inches wide, which are secured to the studs 40 by screws 54.

Studs 40 have a row of apertures 49 spaced longitudinally along the length of their main webs 42. These apertures 49 are provided to allow for the convenient passage of electrical conduits (not shown), structural members 55, and the like through the studs 40.

Figure 12:
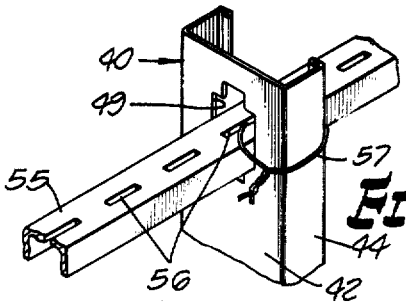
FIG. 12 is a sectional perspective view of an iron bar passing through the studs as is shown in FIG. 2.

As is shown in FIGS. 2 and 12, a structural member, such as black iron bar 55, may be passed through stud apertures 49 in order to provide reinforcing for the wall section 10. Iron bar or furring channel 55 is a U-shaped channel and has elongated slots 56 spaced longitudinally along its web. Iron bar 55 is secured in stud apertures 49 by a piece of wire 57 or the like passing through a bar slot 56, around one side of bar 55, through stud aperture 49, around a stud flange 44, and back through the bar slot 56. The two ends of the wire 57 are then twisted together.

A grommet or insulating guide 60, shown in FIGS. 7, 8, and 9, is inserted in various stud apertures 49 to provide both electrical and thermal insulation and to prevent abrasion between the edges of the metal stud aperture 49 and the electrical conduit (not shown) passing through its aperture. The insulating guide 60 is composed of a material which is not easily ignited, or which is not flammable, such as solid plastic, neophene, or the like.

The insulating guide 60 has a flat front face member 62 of substantially square configuration. Face member 62 has a circular aperture 64 through its center to allow for the passage of electrical conduits through the insulating guide 60. A raised ridge 66 is formed in a relatively square configuration adjacent to the periphery of the face member 62 on the back side of face member 62. Two opposed, outwardly directed flanges 68 are formed integrally with the top of two opposed sides of the ridge 66. Flanges 68 extend laterally outward from the ridge 66 to a point short of the periphery of the face member 62. This is best seen in FIG. 8 which shows the insulating guide 60 from the back side installed in a stud aperture 49.

As is shown in FIGS. 8 and 9, when the guide 60 is installed in a stud aperture 49, the face member 62 is positioned on one side of the stud main web 42 and the flanges 68 are positioned on the other side of the stud main web 42. The face member 62 and flanges 68 are separated by the depth of the ridge 66. Therefore, the ridge 66 has a depth slightly greater than the thickness of the stud 40. In this manner, the face member 62 and flanges 68 will rest close to opposite sides of the stud main web 42 when the guide 60 is installed in the stud apertures 49. The flanges 68 and face member 62 are dimensioned so that they will extend beyond the limits of the stud aperture 49 when the guide 60 is installed. The ridge 66 is positioned on the face member 62 so that the outer side walls 67 of the ridge 66 will bear against the sides of the stud aperture 49 when the insulating guide 60 is installed.

The insulating guide 60 is composed of a material which is flexible so that the insulating guide may be bent and snapped into place in the aperture 49. When the insulating guide 60 is to be installed, the guide 60 is held so that the flanges 68 are positioned adjacent to the vertical sides of the aperture 49 and are closer to the stud main web 42 than the face member 62. One flange 68 of the insulating guide is then inserted through the aperture 49 so that it bears against the side of the stud web 42 opposite from the face member 62. Pressure is then applied on about the central vertical axis of the insulating guide 60 to bend the central portion of the guide inwardly. In this bent position, the remaining flange 68 of the insulating guide 60 is passed through the aperture 49 so that both flanges 68 are on the same side of the main stud web 42 opposite from the face member 62. The pressure in the center of the insulating guide 60 is now released and the insulating guide snaps into position with the flanges 68 and face member 62 bearing against opposite sides of the stud web 42.

The flanges 68 and face member 62 prevent motion of the insulating guide 60 along the X—X axis. The proximate positioning of the outer side walls 67 of the ridge 66 and the sides of the aperture 49 will prevent vertical and horizontal lateral motion of the guide 60 along the Z—Z and Y—Y axes respectively.

The general square or rectangular configuration of this insulating guide 60 was chosen because of the configuration of the aperture 49. However, it will be recognized that many other overall configurations of this insulating guide could be employed, depending upon the configuration of the aperture in which the insulating guide 60 is to be installed, all while employing the principles of this invention.

As is shown in FIG. 2, a metal stud 40 is positioned adjacent to the one end of the cap member 20 and floor track member 30 of each wall section 10 to form a closed end for the wall section 10. A wooden end stud 41 is secured adjacent to the other end of wall section 10 in order to provide a closed end for wall section 10 and a corner stud to which another wall section may be secured. End stud 41 is in the form of a 4×4 wooden member. If wall section 10 is not to form a corner at one end, two metal studs 40 are used as end studs. These end studs 40 are secured between cap member 20 and the floor track 30 with their flanges facing inwardly towards each other. This orientation of the end studs 40 of the wall section 10 aids in securing various wall sections 10 together.

Wall sections of this invention are secured together by securing the main webs 42 of the end studs 40 together by nails, rivets, screws, or the like. If a corner is to be formed by two wall sections, the web 42 of one metal end stud 40 of one wall section is secured to a wooden end stud 41 of the other wall section by nailing and the like.

Figure 10:
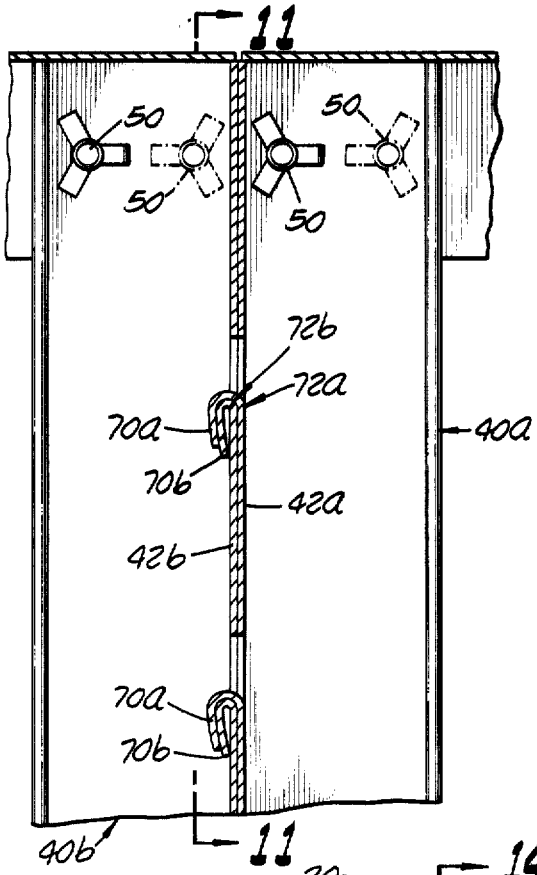
FIG. 10 is a sectional elevation view of a portion of two wall structures of this invention secured together.
Figure 11:
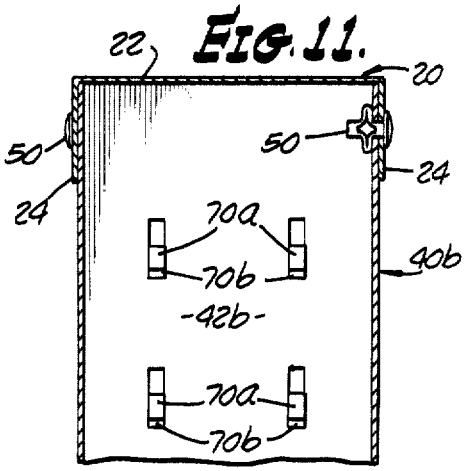
FIG. 11 is a sectional elevation view taken along the line 11—11 of FIG. 10.

In the best embodiment of the invention, wall sections 10 and 11 are secured together by clinching together two stud main webs 42, as is shown in FIGS. 10 and 11. Clinching or staking is the process by which contiguous or contacting portions of two adjacent members are cut or punched out along a U-shaped line on all sides except one side and these cut out portions or flaps are then bent in one direction over the side at which they remain attached. In this manner, the cut out portions of both members are bent or folded over in one direction to hold the members together. As was previously mentioned, this process of clinching may also be used in place of riveting to secure the studs 40 to the cap member 20 and floor track member 30.

FIG. 10 shows end studs 40*a* and 40*b* of two wall sections which are to be secured together by clinching. Adjacent portions of the webs 42*a* and 42*b* of both studs 40*a* and 40*b* are cut or punched out on all sides except along the lines or edges 72*a* and 72*b*. This creates flaps of metal 70*a* and 70*b* hinged about lower edges 72*a* and 72*b*. Flaps 70*a* and 70*b* are then bent over in the same direction. In this case, flap 70*b* is pressed against web 42*b* of stud 40*b* and flap 70*a* is pressed on top of flap 70*b*.

The foregoing description of the invention applies to the best embodiment of all of the wall sections of this invention. However, wall sections 10 and 11 shown in FIG. 1 differ from section 12 in that sections 10 and 11 are adapted for a special function.

Figure 13:
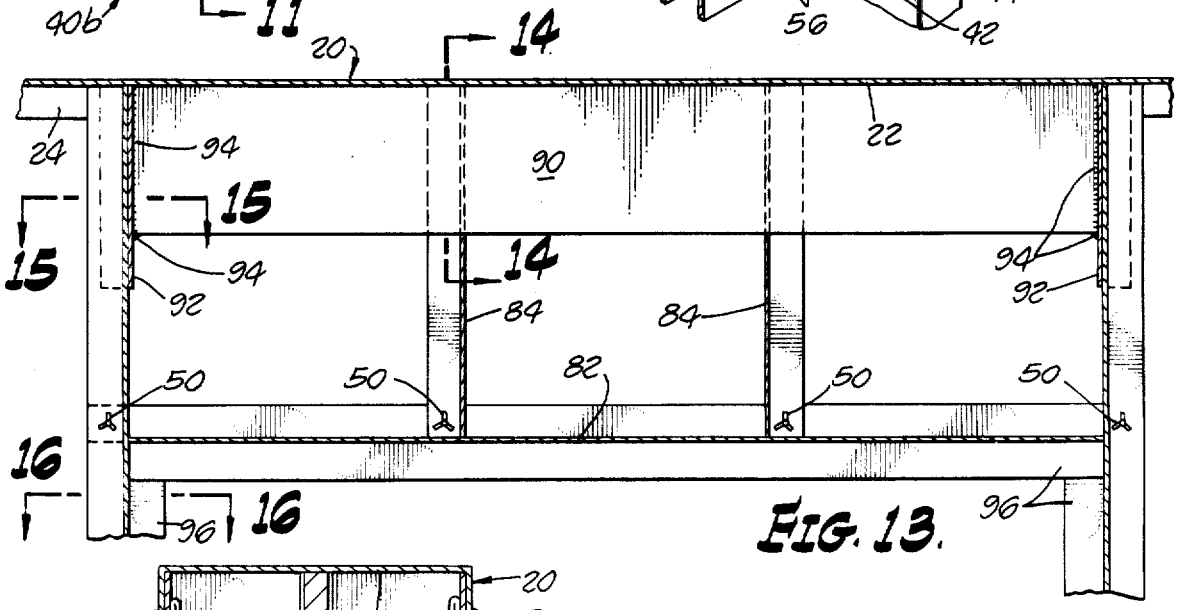
FIG. 13 is a sectional elevation view of a portion of the wall structure along line 13—13 in FIG. 2.
Figure 14:
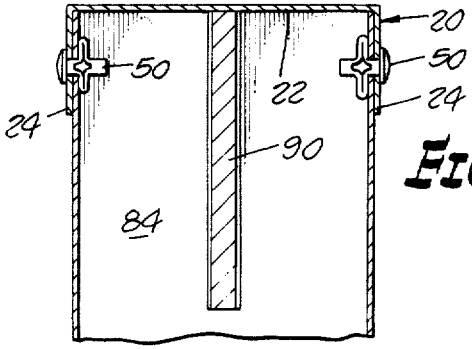
FIG. 14 is a sectional elevation view taken along the line 14—14 of FIG. 13.

The embodiment of the invention shown in FIGS. 2, 13, and 14 is a wall section 10 having an aperture or doorway 80 formed in the wall section. The doorway 80 is defined by an uninterrupted stud 40 on each side of the doorway 80, by the floor track 30, and by a lintel 82 across the top of the doorway 80. Floor track 30 extends across doorway 80 in order to increase the rigidity of the section 10 during shipment. However, track 30 across doorway 80 is cut away thereafter in order to open the aperture 80 at its lower end. An uninterrupted stud 40 is one which extends continuously between the cap member 20 and the track member 30.

The lintel 82 is constructed of a U-shaped channeled member having upwardly facing flanges and is secured to the flanges of the studs 40 on either side of the doorway 80 by rivets 50 or the like.

Cripples 84 are studs 40 which have been cut, fitted, and secured between the cap 20 and the lintel 82. The lower ends of the cripples 84 are secured to the lintel 82 by rivets 50 or the like. Similarly, the upper ends of cripples 84 are secured to cap member 20 by rivets 50.

A header 90 is secured over the doorway 80. The webs 86 (FIG. 14) of the cripples 84 are notched at their upper ends in order to receive the header 90. The header 90 (FIGS. 13 and 15) consists of a plate, such as a ¼ inch thick steel plate, which is secured to a pair of truncated outwardly-facing U-shaped channeled members 92 at each end of the header 90 by welds 94. The header 90 is typically about 8 inches in height and the channels 92 are about 10 inches in length. The top of the header 90 is welded flush with the tops of the channels 92 so that the header will support the web 22 of the cap member 20 when installed.

In order to prevent this portion of wall section 10 from being thicker than the rest of the wall section, channels 92 are constructed with the same width as the rest of the studs 40. In order to fit uninterrupted studs 40 inside of channels 92, the uninterrupted studs 40 on each side of aperture 80 are formed with their webs 42 reduced in width. The studs 40 on each side of the aperture 80 are then fitted inside the respective channels 92. The U-shaped channels 92 are secured to the uninterrupted studs 40 (FIGS. 2 and 15) on each side of the doorway 80 by rivets 50. In this manner, the weight above the doorway 80 is transferred to the uninterrupted studs 40 on each side of the doorway 80 by the header 90.

As is shown in FIGS. 2 and 13, wooden 2×4 surrounds 96 are secured to the inside of the uninterrupted studs 40 on each side of the aperture 80 and to the bottom of the lintel 82. These wooden surrounds 96 are secured to the webs of the metal uninterrupted studs 40 and lintel 82 by nails 98 (see FIG. 16). Surrounds 96 provide for the ready installation of jambs and the like for doorway 80.

FIG. 17 shows another form of header installation employed in this invention. In this embodiment, header 91 is secured to U-shaped channeled members 93 by welds 95 and is placed in the notches in the cripples 84 as described above. However, channels 93 face inwardly towards each other. Thus, the ends of the header 91 are secured between the flanges of the channels 93.

In this embodiment of the invention, a pair of uninterrupted studs 40 are provided at each side of the aperture 80. The studs 40 of each pair are secured back-to-back by rivets 50 through their webs 42. Channels 93 are secured inside of the innermost studs 40 by these same rivets 50 through the web of the channel 93.

In this embodiment of the invention, the wooden surrounds 96 are secured to the sides of the aperture 80 below lintel 82 by the use of outwardly facing U-shaped metal channels 100 (see FIG. 18). Channels 100 are fitted over the outside of each of the innermost uninterrupted studs 40 of each stud pair at each side of the aperture 80 so that the flanges 104 of channels 100 embrace the flanges 44 of the studs 40. Channels 100 extend from the floor track 30 to the lintel 82. Rivets 50 through the flanges of the studs 40 and channels 100 secure the studs 40 and channels 100 together. The channels 100 are fitted over studs 40. Surrounds 96 are secured to the webs of channels 100 and to the lintel 82 by nails 98.

As previously described, the webs 42 of the innermost studs 40 of each stud pair have a reduced width in order that the thickness of channels 100 may be the same as the thickness of the rest of the wall section 10.

Wall section 11 of FIG. 1 has an aperture 102 similar to aperture 80 of wall section 10, except that aperture 102 of section 1 forms a window for the wall section 11. This construction necessitates a sill 104, similar to lintel 82, at the bottom of window aperture 81. Shortened studs 106 are also secured between the floor track 30 and the sill 104. These shortened studs 106 are similar to cripples 84 above aperture 102 and are secured to the sill 104 in a manner similar to the manner in which cripples 84 are secured to lintel 82. Otherwise, the construction of the members surrounding and above window aperture 102 are the same as have been described above.

It will be understood that other apertures, such as other shapes of windows and the like, may be formed in a manner similar to that disclosed above, all within the scope of this invention.

Although this invention has been described with reference to a particular embodiment and to particular applications, the principles involved are susceptible to numerous other applications, which will be apparent to those skilled in the art, and the scope of the invention is not to be limited to the preceding embodiments.

The invention claimed is:

1. A lightweight, prefabricated wall section module transportable as an integral unit to a building site for erection on a floor in a building construction, said module being sufficiently flexible to conform to irregularities in said floor, said module comprising:

a plurality of vertically extending, flexible studs of non-planar cross-sectional shape, each of which studs is fabricated of lightweight strip steel having a thickness no greater than 18 gauge, said studs being free of reinforcing wood material along their lengths;

an elongated, normally horizontal, flexible floor track member of U-shaped cross section at least 10 feet in length embracing and secured by metal fasteners to the lower ends of said non-planar steel studs, said track member forming the bottom of said module during its transport and erection and being fabricated of lightweight strip steel having a thickness no greater than 18 gauge;

an elongated, normally horizontal, flexible cap member of U-shaped cross section at least 10 feet in length embracing and secured by metal fasteners to the upper ends of said non-planar steel studs, said cap member being fabricated of lightweight strip steel having a thickness no greater than 18 gauge;

and at least one elongated normally horizontal wooden top plate having a length substantially equal to that of said cap member and of said floor track member and extending in the direction of elongation of said steel cap member, said wooden top plate being secured to said cap member by fasteners extending between said wooden top plate and said steel cap member whereby said wooden top plate comprises an integral portion of said module and forms the top of said module during its transport to and erection at said building site;

the length of the module being greater than its height;

said transportable module being free of coextensive wall-surface material, during transportation of said module to said building site.

2. A prefabricated wall structure as defined in claim 1, in which said floor track member is free of any reinforcing plate during transportation.

3. A prefabricated wall structure as defined in claim 1, in which said floor track member and said cap member are of simple U-shape, being free of lateral projections.

4. A lightweight flexible, prefabricated wall section module substantially free of reinforcing coextensive wall-surface material and transportable as an integral unit to a building site for use as an external load-bearing wall of a building, said module being between 10 feet and 20 feet in length and having a height less than its length, said module comprising:

a plurality of vertical extending, flexible studs of non-planar cross section each of which studs is fabricated of lightweight strip steel having a thickness of about 20 gauge, said studs being free of reinforcing wood material along their lengths;

an elongated normally horizontal, flexible floor track member embracing and secured by metal fasteners to the lower end of said non-planar steel studs, said track member forming the bottom of said module during its transport to said building site and being fabricated of lightweight strip steel having a thickness of about 20 gauge;

an elongated normally horizontal, flexible cap member overlying, embracing, and secured by metal fasteners to the upper ends of said non-planar studs, said cap member also being fabricated of lightweight strip steel having a thickness of about 20 gauge;

and at least one elongated normally horizontal wooden top plate having a length substantially equal to that of said steel cap member and extending in the direction of elongation of said steel cap member, said wooden top plate being fixedly attached to said cap member externally of said module as an integral portion of said module prior to transport of said module to said building site and forming the top of said module during its transport to and erection at said building site.

5. The transportable wall section module of claim 1 wherein said module is provided with at least one elongated normally horizontal wooden top plate having a length substantially equal to that of said cap member and extending in the direction of elongation of said cap member, said wooden top plate being secured to said cap member and extending in the direction of elongation of said cap member, said wooden top plate being secured to said cap member externally of said module as an integral portion of said module and forming the top of said module during its transport and erection.

6. A module as defined in claim 5 wherein said pair of studs have webs extending perpendicular to the flanges of said cap member and said floor member, each of said pair of studs having flanges extending from the opposite edges of said stud webs in directions away from said opening.

7. A module as defined in claim 5 wherein said U-shaped lintel comprises a web having flanges extending vertically upward from opposite sides thereof, and a plurality of shortened studs engaging and extending past said header, the opposite ends of each of said shortened studs extending between the downwardly depending flanges of said cap member and between the upwardly extending flanges of said lintel respectively, said shortened studs being secured to said cap member and to said lintel.

8. A module as defined in claim 5 including wooden members secured to said pair of studs and to said lintel in at least partially surrounding relation to said opening for framing said opening.

9. A prefabricated wall section module transportable as a unit to a building site for use in building construction, said module comprising:

a downwardly facing, elongated, normally horizontal U-shaped metal cap member less than approximately 20 feet in length, said cap member having a main web and having flanges depending downwardly from the opposite elongated edges of said main web;

an upwardly facing, elongated, normally horizontal U-shaped floor track member of about the same length as said cap member, said track member having a main web and having flanges extending upwardly from the opposite elongated edges of said main web;

a plurality of uninterrupted metal studs positioned vertically between and secured to said cap member and to said floor track member, the upper ends of said studs extending between the downwardly depending flanges of said cap member and the lower ends of said studs extending between the upwardly extending flanges of said floor track member, said studs being spaced from one another at between one and two foot intervals along said wall section module;

an adjacent pair of said uninterrupted metal studs defining the opposite sides of an opening in said module;

a normally horizontal, metal, U-shaped member positioned between and said parallel to said cap member and track member, said U-shaped member being secured to said pair of studs on each side of said wall section module opening to form a lintel for said opening; and a header positioned above said lintel and below said cap member, said header comprising a reinforcing member engaging said cap member and connected to both of said pair of studs for supporting said cap member and for transferring loads on said cap member to said pair of uninterrupted studs.

10. The module of claim 9 wherein said pair of studs have webs extending perpendicular to the flanges of said cap member and said floor member, each of said pair of studs having flanges extending from the opposite edges of said stud webs in directions away from said opening.

11. The module of claim 9 wherein said U-shaped lintel comprises a web having flanges extending vertically upward from opposite sides thereof, and a plurality of shortened studs engaging and extending past said header, the opposite ends of each of said shortened studs extending between the downwardly depending flanges of said cap member and between the upwardly extending flanges of said lintel respectively, said shortened studs being secured to said cap member and to said lintel.

12. The module of claim 9 including wooden members secured to said pair of studs and to said lintel in at least partially surrounding relation to said opening for framing said opening.

* * * * *